US006676441B1

(12) United States Patent
Knudsen

(10) Patent No.: US 6,676,441 B1
(45) **Date of Patent: *Jan. 13, 2004**

(54) HOUSING FOR AN ELECTRICAL DEVICE

(75) Inventor: Ole Friis Knudsen, Sydals (DK)

(73) Assignee: Danfoss A/S, Nordborg (DK)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 427 days.

(21) Appl. No.: 09/117,603

(22) PCT Filed: Feb. 20, 1997

(86) PCT No.: PCT/DK97/00076

§ 371 (c)(1),
(2), (4) Date: Jul. 31, 1998

(87) PCT Pub. No.: WO97/32363

PCT Pub. Date: Sep. 4, 1997

(30) Foreign Application Priority Data

Feb. 27, 1996 (DE) ..... 196 07 299

(51) Int. Cl.[7] ..... H01R 13/52

(52) U.S. Cl. ..... 439/519; 439/936

(58) Field of Search ..... 439/519, 271–283, 439/521, 936, 604, 606, 587

(56) References Cited

U.S. PATENT DOCUMENTS

| | | | | | |
|---|---|---|---|---|---|
| 4,849,580 | A | * | 7/1989 | Reuter | 174/92 |
| 5,535,512 | A | * | 7/1996 | Armogan | 29/877 |
| 5,637,007 | A | * | 6/1997 | Suzuki et al. | 439/276 |
| 5,662,494 | A | * | 9/1997 | Zennamo, Jr. et al. | 439/589 |
| 5,939,672 | A | * | 8/1999 | Tang | 174/50.5 |
| 5,942,333 | A | * | 8/1999 | Arnett et al. | 428/469 |

FOREIGN PATENT DOCUMENTS

DE G 81 20 430.2 10/1981

* cited by examiner

*Primary Examiner*—Ross Gushi
(74) *Attorney, Agent, or Firm*—Barnes & Thornburg

(57) ABSTRACT

In order, in a simple and reliable manner, to effect a seal in the region of the lead feedthroughs in a housing for an electrical device, in particular a measuring transducer, through the wall (2of which housing at least one electrical lead (3) is introduced into the housing (1) and is sealed against the wall (2) by a sealant, tar (6) is used as the sealant.

1 Claim, 1 Drawing Sheet

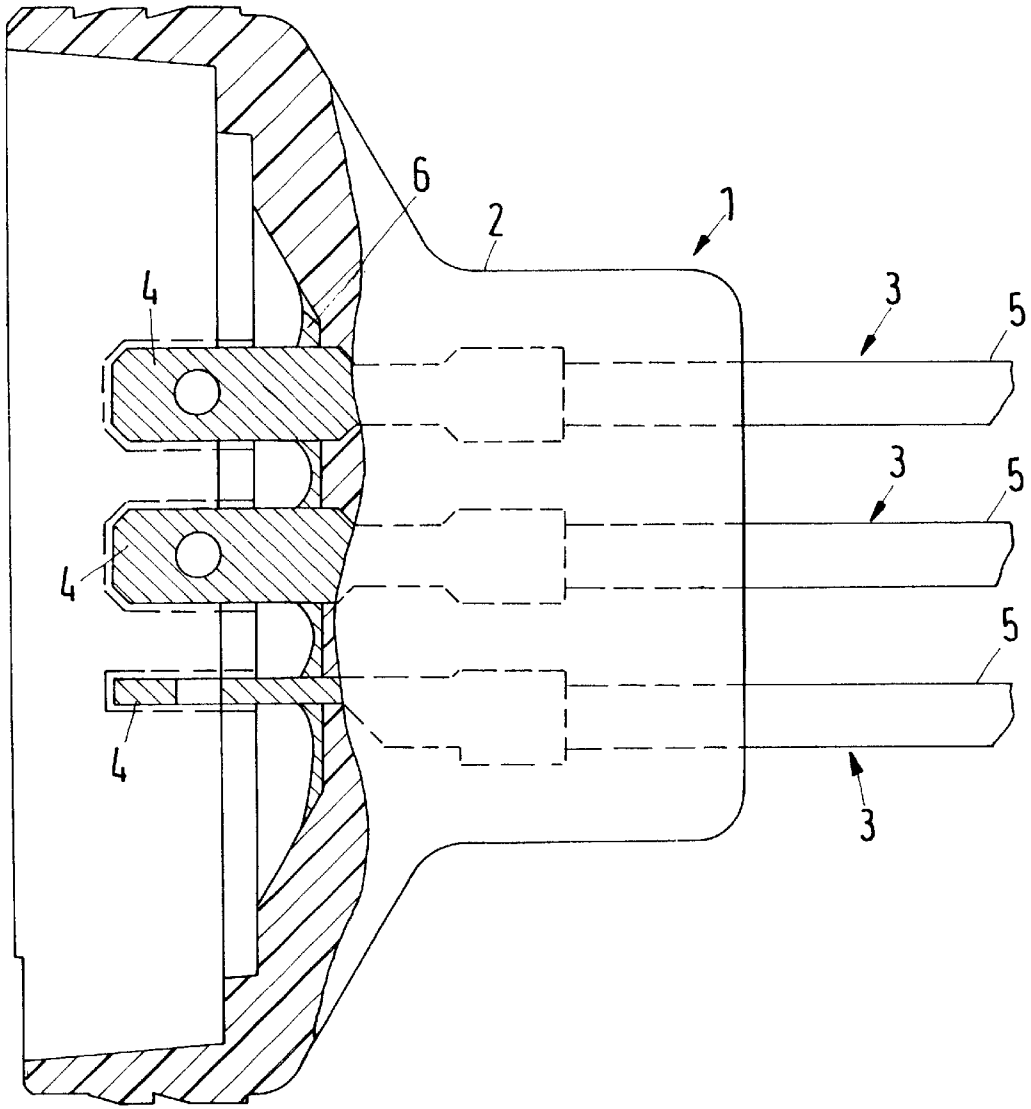
5
5
5
3
3
3
1
2
6
4
4
4

HOUSING FOR AN ELECTRICAL DEVICE

BACKGROUND OF THE INVENTION

The invention relates to a housing for an electrical device, in particular a measuring transducer, wherein at least one electrical lead is introduced into the housing through the wall of the housing and is sealed against the wall by a sealant.

The housings of electrical devices, in particular the housings of measuring transducers, such as pressure transducers, must be adequately sealed even under large fluctuations in temperature and at high environmental humidity, to ensure long service life of the electrical device, mostly at least ten years.

The feedthroughs for electrical leads, which pass right through the housing for connection to the electrical device, must therefore also be adequately sealed. The sealant provided for that purpose must not only not let through any moisture, but must also be flexible and furthermore remain sealed even under changing temperatures. Moreover, it must not impair the conductivity and suitability for soldering of terminals of the leads lying inside the housing. The sealant could cause such an impairment by partly covering the terminals and thus reducing their contact surface for soldering on leads continuing into the inside of the device.

Two-component sealants, synthetic resins and similar substances are often used for that purpose, and a wide choice is commercially available. These sealants are not only expensive, but often also difficult to use, and are not always satisfactory, as experience has shown.

U.S. Pat. No. 4,083,902 describes a seal that consists of two discs. One disc consists of foamable adhesive, which foams at a first temperature and seals a feedthrough opening of a supply lead, thus preventing the actual sealant, consisting of a second disc that fuses at a higher temperature, from flowing away through the lead feedthrough.

According to U.S. Pat. No. 4,910,867, solder terminals are sealed by means of hot-setting adhesive, which in the first instance is placed in strip form on the terminals and is then melted so that it penetrates into the feedthrough openings between the wall thereof and the supply leads.

The methods described are complicated, however. In addition, these sealants impair the suitability of the electrical leads for soldering.

SUMMARY OF THE INVENTION

The invention is based on the problem of providing a housing of the kind mentioned in the introduction, in which sealing of the leads is simpler and more reliable.

According to the invention, this problem is solved by using tar as the sealant.

The tar can be commercial tar, such as roofing tar, which surprisingly has just the qualities desired.

An end portion of each lead projecting into the interior of the housing can be in the form of a terminal for the electrical device. The suitability of this terminal for soldering is not impaired by the sealing method using tar.

BRIEF DESCRIPTION OF THE DRAWINGS

The drawing'shows part of a housing according to the invention, partly in section.

DESCRIPTION OF THE PREFERRED EMBODIMENT

The housing 1, of which only a part serving as cover is illustrated, serves to receive an electrical device in the form of a measuring transducer, in particular a pressure transducer, and is manufactured from plastics material by injection-moulding. Through the wall 2 of the housing 1 electrical leads 3 embedded therein pass into the interior of the housing 1. End portions 4 of the leads projecting into the inside have no insulation and serve as terminals for soldering on further leads that are connected to the electrical device. The outer portions 5 of the leads are provided with insulation.

To seal the leads 3 in the region of their feedthroughs through the wall 2 of the housing 1, ordinary commercially available tar 6 is applied as sealant to the inside of the wall 2 around the terminals 4. The tar can be roofing tar known by the trademark "Icopal", available under the type name "T-UN No. 1030139" from the firm Jens Villadsens Fabrikker, Herlev, Denmark. The tar 6 is fluid at normal ambient temperature and is applied in an amount of 0.5 $cm^3$. The tar spreads out easily and forms a circular ring which seals the terminals 4 completely against the wall 2, as tests have demonstrated. The tar penetrates in particular by capillary action into any small voids between the conductors and the feedthrough openings and into crevices or cracks. The thickness of the tar layer is about 0.5 to 1 mm and its drying time is about 3 hours. As soon as the tar is dry, it forms a solid and sealed connection between the terminals 4 and the wall 2, without impairing the suitability of the terminals 4 for soldering. In the case of other sealants which were tested, deposits formed on the terminals, which degraded both the mechanical and also the electrical connection with the inner supply leads of the electrical device.

The tightness of the seal by the tar 6 was tested as follows: the housing sealed hermetically by means of the cover was maintained for one hour at a temperature of 93° C. The housing, including the lead portions projecting from the housing, was then immersed fully in ice water to effect a cold shock and to test whether the tar contracts during cooling and whether as a result water penetrates into the housing. Before immersing the housing into the water, it was weighed, and after a predetermined holding time it was weighed again. The weight difference was less than 0.1 g. To make sure that this weight difference did not come about as a result of any absorption of water by the housing material, the housing was again immersed for a duration of 24 hours in the ice water on the assumption that absorption of water by the housing material had by that time finished, that is, the housing material was saturated with water. The housing was subsequently again immersed for a duration of 48 hours in the ice water, then weighed again and the difference of the last two weight measurements was formed. The difference was virtually 0 g, which indicates a virtually complete seal of the lead feedthroughs.

What is claimed is:

1. Housing for an electrical device, having at least one lead having an outer portion that is electrically insulated and an end portion that is not insulated, the lead being introduced into the housing through a wall of the housing with the end portion of the lead comprising a non-insulated terminal for the electrical device, the non-insulated terminal extending through the wall into an opening in the housing and being sealed against the wall by a sealant, the sealant comprising pure tar which is liquid when applied and which then cures after application.

* * * * *